United States Patent [19]

Hornsby, Jr.

[11] 3,936,052

[45] Feb. 3, 1976

[54] PROJECTOR AND DISPENSER ACTIVATED WHEN ALL TARGETS ARE HIT

[76] Inventor: James R. Hornsby, Jr., 6239 Edgewater Drive, Orlando, Fla. 32810

[22] Filed: Nov. 18, 1974

[21] Appl. No.: 524,737

[52] U.S. Cl. ..... 273/101; 273/102.1 G; 124/26

[51] Int. Cl.[2] ..... F41J 7/00; A63B 71/00

[58] Field of Search ..... 273/1 R, 37, 95 R, 101, 273/102.1 R, 102.1 C, 102.1 G, 127 R, 127 D; 124/26, 36, 39, 41 R, 27

[56] References Cited

UNITED STATES PATENTS

| | | | |
|---|---|---|---|
| 915,563 | 3/1909 | Darling | 124/26 |
| 1,182,444 | 5/1916 | Auch | 124/26 |
| 1,927,424 | 9/1933 | Trobenbach | 124/26 |
| 1,944,317 | 1/1934 | Gostavson | 273/102.1 C |
| 2,949,305 | 8/1960 | Davis | 273/102.1 R |
| 3,495,828 | 2/1970 | Kymla | 273/101 |
| 3,561,761 | 4/1969 | Klemma | 273/102.1 C |
| 3,787,052 | 1/1974 | Glass | 273/102.1 C |
| 3,822,887 | 7/1974 | Freedman | 273/102.1 G |

FOREIGN PATENTS OR APPLICATIONS

| | | | |
|---|---|---|---|
| 626,725 | 9/1927 | France | 273/41 |

*Primary Examiner*—Anton O. Oechsle
*Assistant Examiner*—Marvin Siskind
*Attorney, Agent, or Firm*—Roylance, Abrams, Berdo & Kaul

[57] ABSTRACT

An upstanding face member, having decorative indicia thereon in the form of a pirate ship, is provided with an aperture. A pair of projectile firing devices are positioned behind the face member, with the barrels from the firing devices extending through the face member to simulate guns. A plurality of pirate-simulating targets are rotatably mounted for movement from an upright position extending above the face member to a collapsed position. Such movement of the targets occurs when the targets are struck by projectiles fired from an opponent's firing device. A container is mounted behind the aperture and is movable between a closed object-containing position and an open position where objects are released through the aperture. A controlling member coacts with the targets and the container to retain the container in its closed position so long as at least one of the targets remains in its upright position. When all of the targets have been knocked down to their collapsed position, the controlling member releases the container which moves to its open position and releases the objects, which simulate treasure, through the aperture.

21 Claims, 6 Drawing Figures

FIG. 2
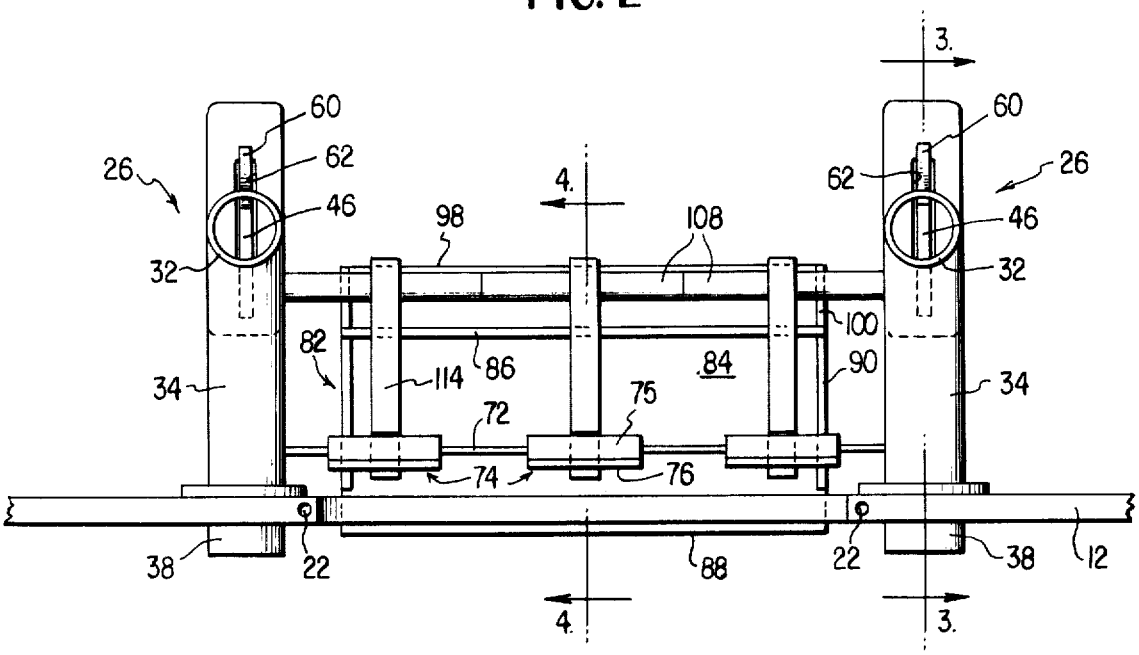
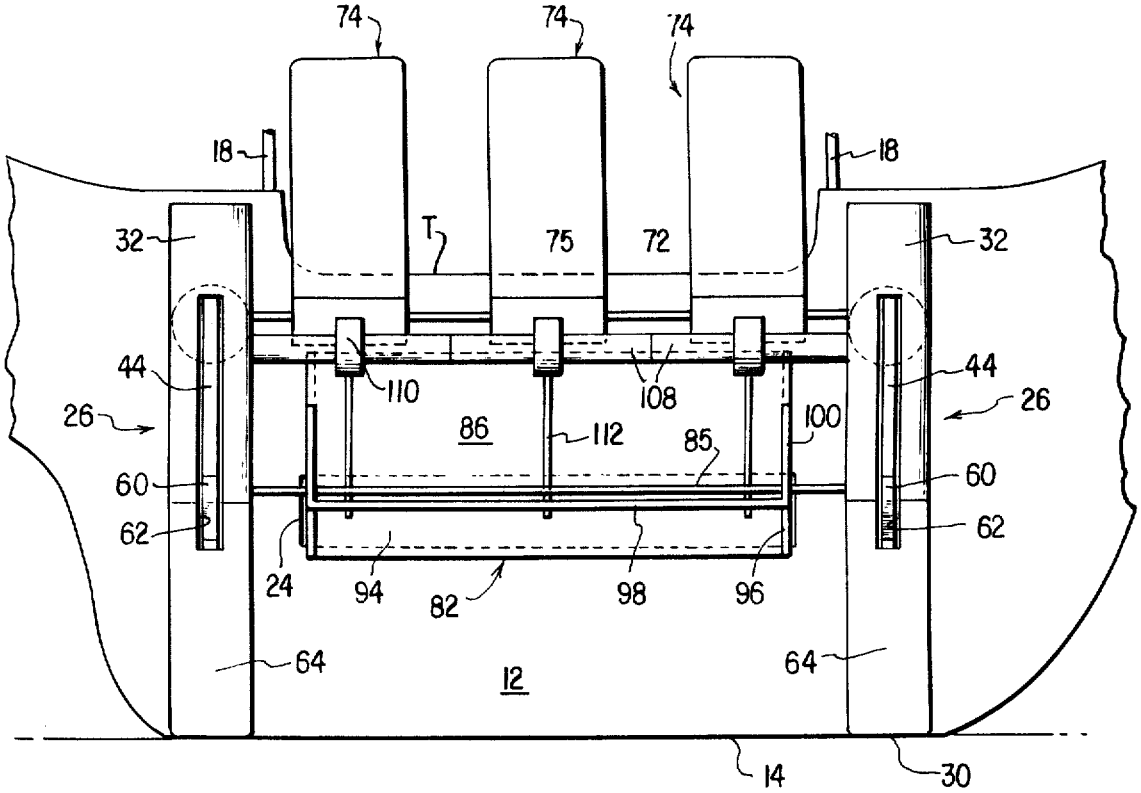
FIG. 6

PROJECTOR AND DISPENSER ACTIVATED WHEN ALL TARGETS ARE HIT

This invention relates to amusement devices and more particularly it relates to an amusement device in the form of a simulated battle game in which a pair of players, each supplied with the same equipment, engage in mock battle with one another.

It is a known fact that children enjoy competitive games in which one player pits his skill against the opposing player. In recognition of this fact, there have been many forms of amusement devices in the form of competitive games, such as toy baseball, football, basketball, hockey and other forms of games. All such competitive games require a certain degree of skill on the part of the players and are hence entertaining to the children who play the games and are valuable for developing their skill and coordination.

It is also a known fact that children enjoy simulated battles. Thus, many children play guns cowboys and indians, usually simulating the sounds of battle without actually firing any projectiles at one another. The reason for this is that projectile firing apparatus has been considered to be dangerous and capable of being misused.

It is an object of the present invention to combine the best features of competitive type games with those of simulated battle to provide a new and unusual form of amusement device which is both entertaining and skill developing.

It is another object of the present invention to provide a competitive game capable of being played by two or more players wherein the more skillful of the players achieves a "reward."

It is another object of the present invention to provide an amusement device in the form of a game of skill incorporating projectile firing devices and knockdown targets whereby a player can fire projectiles to knock down his opponent's targets, and vice versa, and wherein certain objects are released when all of the targets have been knocked down.

It is another object of the present invention to provide an attractive, amusing game of skill and chance, which can be played by adults or children, and which is safe to use and enjoyable to play.

Another object of the present invention is to provide an amusement device in the form of a simulated battle game, which device is relatively simple in construction and is capable of extended play without failure or breakage, yet which incorporates many movable parts.

Other objects, advantages and salient features of the present invention will become apparent from the following detailed description, which, taken in conjunction with the annexed drawings, discloses a preferred embodiment thereof.

The foregoing objects are attained by providing a game wherein two or more players are each provided with an upstanding face member having decorative indicia thereon. In the preferred embodiment described herein, such decorative indicia makes the face member simulate a pirate ship, but, of course, the invention need not be limited to a game utilizing this particular form of indicia. A pair of projectile firing devices are positioned behind the face member, with each projectile firing device having an upstanding tube into which projectiles can be digitially loaded and a forwardly extending barrel which passes through the face member to simulate a gun barrel. A digitally operable trigger is spring biased forwardly and when such trigger is digitally retracted, a projectile from the open tube falls into alignment with the barrel. Hence, when the trigger is released, the projectile will be fired forwardly through the barrel and at corresponding equipment being played by an opposing player. The trigger mechanism for the firing device incorporates a projection which enters the barrel when the trigger is retracted, thereby preventing the players from loading any elongated projectiles such as pencils or the like into the barrel.

Each game incorporates a plurality of normally upstanding targets which either simulate or have indicia thereon simulating pirates. While these targets are normally upstanding, they can be knocked rearwardly to a downward or collapsed position when they are struck by a projectile fired from an opponent's projectile firing device. The face member includes an aperture therein and a container means is mounted behind the aperture and is adapted to contain suitable objects. In the preferred embodiment, the objects can take the form of simulated treasure. In the normal position, while the targets are in their upstanding or upright position, the container is in a closed position and the objects are hence retained therein. However, the container is also movable to an open position whereat the objects from the container means are released through the aperture in the face member.

Control means or control devices are provided to coact with the targets and the container means. The purpose for such control means is to assure that the container will remain in its closed position until all of the targets have been knocked down by projectiles fired from an opponent's gun. Once the last of the targets has been knocked down, the control means releases the container to permit it to move to its open position where the objects therein are discharged through the aperture in the face member.

The control means itself takes the form of a plurality of rotatably mounted members, each of which carries a fowardly extending arm and a depending spring finger. Each spring finger is fitted into a slot in a flange carried at the rear of the container means. The forwardly projecting arm has a notch adjacent the front thereof into which the bottom of the target normally fits. The arm also carries a rearwardly extending finger which ordinarily engages against the top of the container back wall, thus preventing the container from rotating to its open position. In the preferred embodiment, one control device is provided for each of the targets. As each target is knocked down by a projectile fired from an opponent's firing device, the bottom of that target is released from the notch in the associated arm. Because each control device is resilient, due to the urging of the spring finger, the arm itself will bias upwardly somewhat after the associated target has been knocked back. This upward biasing releases the finger from engagement with the container rear wall. Once the final target has been knocked down and the final finger released from engagement with the container rear wall, the container is no longer restrained and is hence free to rotate downwardly to its open position which discharges the objects through the aperture in the face member.

Referring now to the drawings which form a part of this original disclosure:

FIG. 2 is a top plan view of the amusement device of FIG. 1;

FIG. 6 is a rear elevational view of the amusement device.

Figure 1:
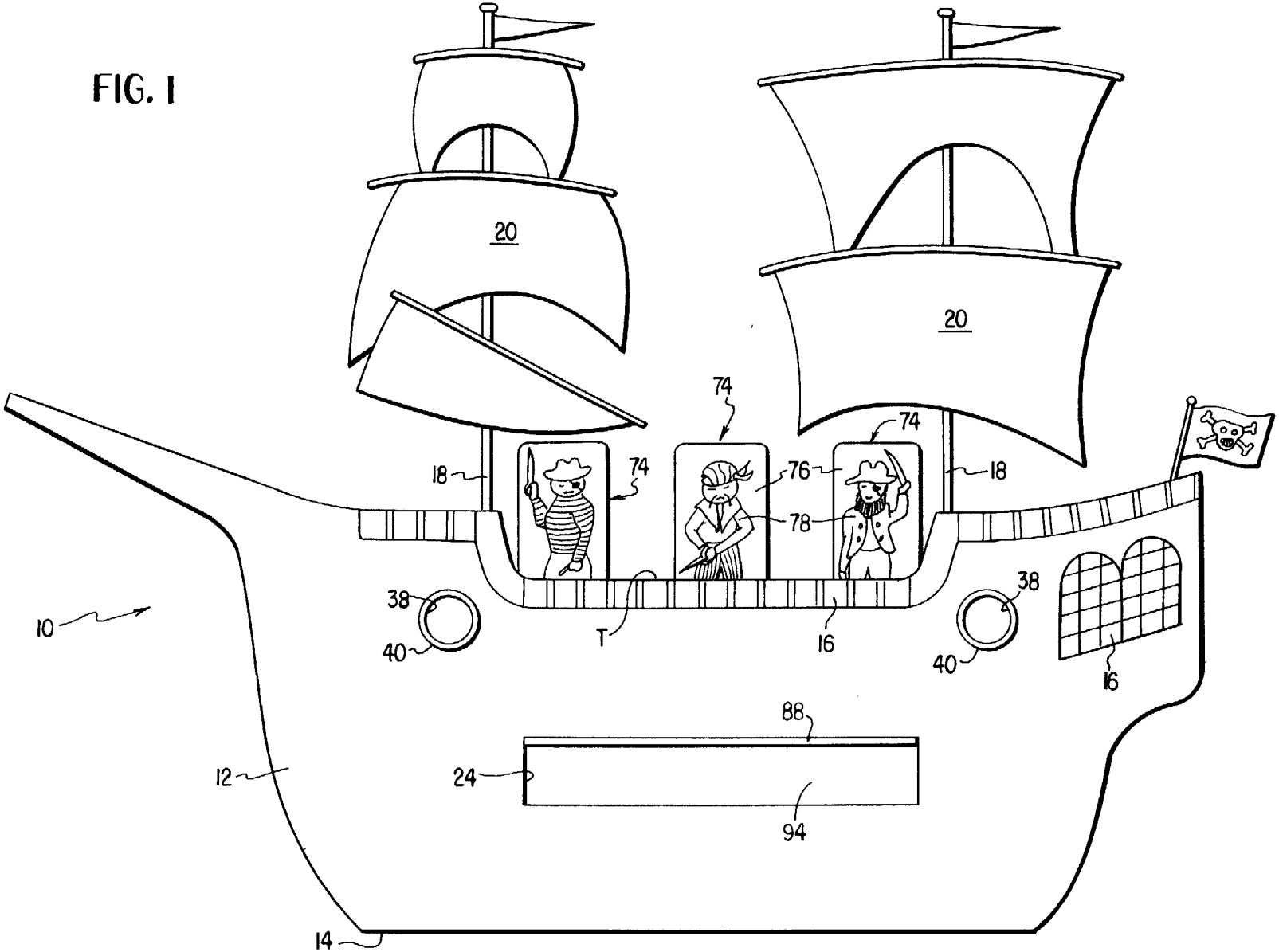
FIG. 1 is a front elevational view of an amusement device in accordance with the principles of the present invention.

Referring now to the drawings in further detail, there is illustrated in FIG. 1 an amusement device in accordance with the principles of the present invention, such device being generally designated 10. The amusement device includes an upstanding face member 12 in the form of a sheet of material such as wood, paper, plastic or the like. The sheet 12 is provided with a flattened bottom 14 which enables the sheet to rest against the ground or a supporting surface for the amusement device. As shown in FIG. 1, the sheet 12 is configured in such a fashion as to simulate the appearance of a pirate ship. Decorative indicia 16 can be imprinted on the front surface to further simulate the appearance of a ship. Upstanding masts 18 carrying simulated sails 20 can be formed with or attached to the face member 12 for the purpose of further simulating the appearance of a ship. If desired, the masts 18 can be in the form of rods which fit into apertures 22 in the top surface of the face member 12, as illustrated in FIG. 2. A central aperture 24 having a rectangular configuration is provided through the face member 12 for purposes to be described hereinafter.

Figure 3:
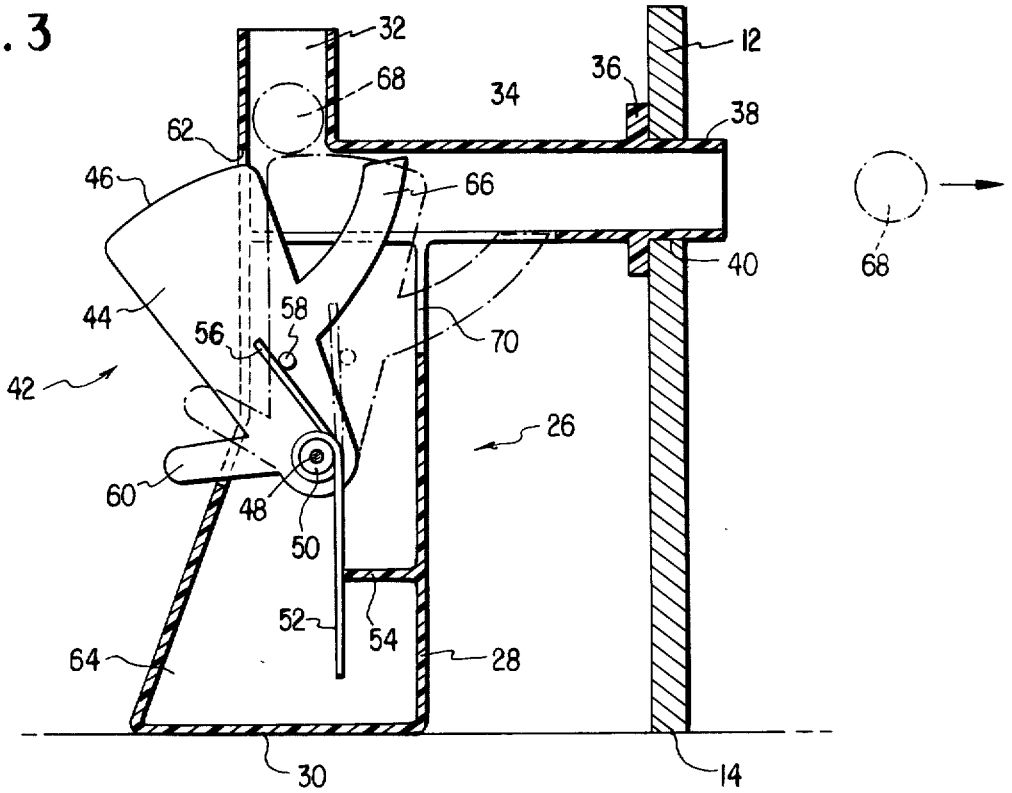
FIG. 3 is a sectional view taken along the lines 3—3 of FIG. 2.

If attention is now directed to FIG. 3, there is illustrated therein a projectile firing device generally designated 26. Each projectile firing device includes a hollow lower portion 28 having a flat bottom 30 which is adapted to engage the ground or the supporting surface for the amusement device. The flat bottom 30 is preferably aligned with the flat bottom 14 of the face member 12 and since two firing devices 26 are provided, as illustrated in FIG. 2, the flat bottom 30 on the firing devices and the flat bottom edge 14 on the face member serve to assure that the entire amusement device will freely stand in an upright fashion.

The firing device further includes an upstanding open topped loading tube 32 which merges perpendicularly into a forwardly extending launching or firing barrel 34. The barrel itself carries a flange 36 which fits against the reverse side of the face member 12, as illustrated in FIG. 2. A projecting portion 38 along the barrel extends forwardly from the flange 36 and fits through an aperture 40 in the face member. As such, the extending portion 38 serves to simulate a gun barrel through which a player's projectiles are fired or launched.

A digitally operable trigger mechanism generally designated 42 is provided within the firing device 26. The trigger mechanism includes an elongated central body portion 44 having a top surface 46 and having a somewhat smaller lower surface. A transverse pivot pin 48 mounts the trigger for rotational movement between the solid line retracted position of FIG. 3 and the phantom line advanced position of FIG. 3. A biasing spring is mounted on a projection 50 extending from the lower portion of the trigger section 44 to normally urge the trigger to its forward position. The biasing spring includes a lower arm 52 which abuts against an inner projection 54 of the firing mechanism base portion 28. The biasing spring also includes an upper arm 56 which abuts against a projecting pin 58 on the trigger portion 44. A digitally engageable handle 60 extends from the lower portion of the trigger member 44 to enable the trigger to be digitally retracted through a slot 62 in the firing mechanism housing 64. An integral projection 66 extends forwardly and upwardly from the trigger portion 44 as illustrated in FIG. 3. Thus, when the trigger is in its fully retracted position as shown in solid lines in FIG. 3, the projection 66 closes the barrel 34, thus preventing a player from introducing any elongated projectile such as a pencil into the barrel. When the trigger is released to move under the biasing force of the spring to its phantom line position of FIG. 3, the projection 66 is retracted so it no longer blocks the barrel.

Projectiles 68 in the form of foam plastic spheres are introduced into the firing device through the top of the tube 32. When the trigger is in its normal forward position, the lowermost projectile simply rests against the top portion 46 of the trigger. However, when the trigger is retracted to its solid line position of FIG. 3, the projectile can drop downwardly into the rear portion of the barrel 34, between the segment 44 and the projection 66. Then, when the trigger is released, the forward biasing force of the spring propels the projectile fowardly and out through the barrel 34. An internal slot 70 is provided through the central portion of the barrel and part of the housing 64 to facilitate passage of the trigger portions 44 and 66.

As shown in FIGS. 2 and 6, a pair of firing devices 26 are provided, with the firing devices being spaced apart one from the other. A rod 72 extends between these firing devices adjacent the top thereof to serve as a mounting means for the various targets.

Figure 4:
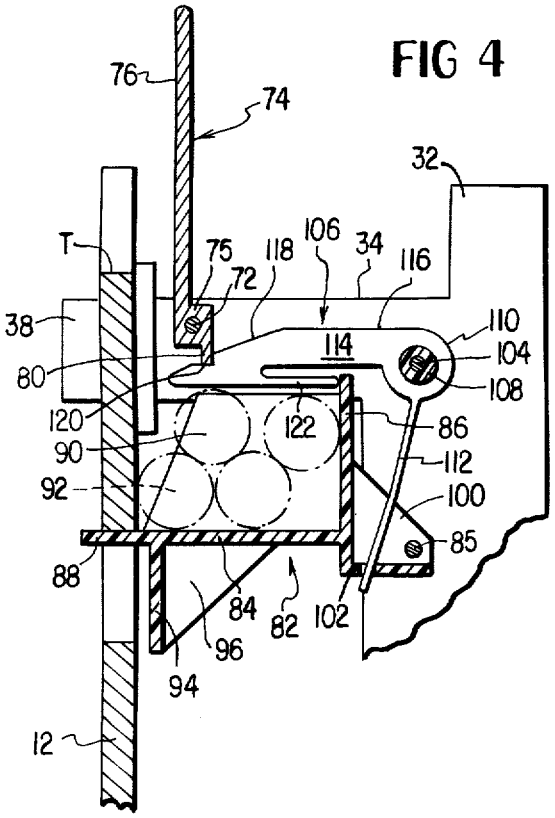
FIG. 4 is a sectional view taken along the line 4—4 of FIG. 2.
Figure 5:
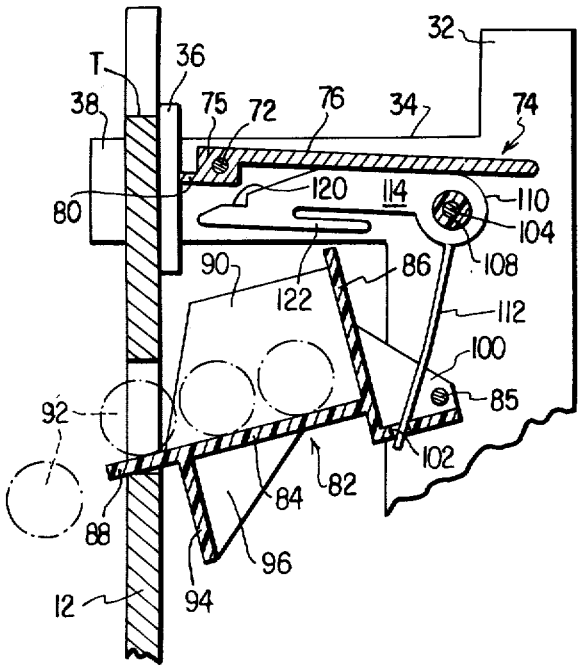
FIG. 5 is a sectional view, similar to FIG. 4, but showing the container means moved to its open position.

As best shown in FIGS. 4 and 5, each target is generally designated 74. It includes a body portion 75 through which the rod 72 horizontally projects. Each target 74 is freely rotatable upon the rod 72, and, in the preferred embodiment, is slidable therealong to any desired lateral position. It is also possible to place cylindrical spacer tubes along the rod to thus predetermine the positions of the targets 74 and prevent them from being slidable along the rod 72 even though they must still remain rotatable about such rod. Each target 74 includes an elongated upper portion 76 in the form of a panel which projects above the top surface T of the face member 12 when the target is in the upright position as shown in FIG. 4 and also as shown in FIG. 1. Decorative indicia 78 can be applied to the front of the panel 74 as illustrated in FIG. 1 so that each target panel resembles a pirate. As an acceptable alternative, the entire upper panel portion 76 can be configured to simulate the pirate and the indicia 78 can then be imprinted upon this figure. Each target 74 also includes a lower portion 80 which can also be called a lower edge portion and it is this lower portion 80 which cooperates with the control means in a manner to be described hereinafter to retain the targets in their upright position initially.

A container means generally designated 82 is provided behind the aperture 24 and the face member 12. The container means 82 is itself rotatably mounted upon a transversely extending rod 84 which extends between the spaced projectile firing devices 26. The container means 82 includes a basewall 84 which perpendicularly intersects with an upstanding rear wall 86. The basewall 84 includes a forward lip portion 88 which at least partially projects through the aperture 24 in the face member 12. The container means also includes a pair of spaced sidewalls 90, which, in conjunction with the basewall 84 and the rear wall 86 and the rear surface of the face member 12 serve to define a receptacle or chamber into which objects 92 can be introduced. The objects 92 in the preferred form of this invention are intended to simulate treasure, such as a pirate treasure, and hence they can be simulations of objects such as gold balls or bars or coins. The container means also includes a lower wall 94 which depends from the basewall 84 and which extends across the rear surface of the face member 12 to cover the aperture 24 when the container is in its closed position. A reinforcing web 96 can extend between the lower wall 94 and the basewall 84.

A rearwardly extending flange 98 extends from the back of the container rear wall 86. Sidewalls 100 extend between this flange 98 and the rear wall 86, and the rod 84 extends through these sidewalls 100 thereby rotatably mounting the container means 82. Slots or slot means 102 are formed in spaced relation along the flange 98 for the purpose of receiving a portion of the control means in a manner to be described hereinafter.

A further rod 104, as illustrated in FIGS. 4 and 5, is provided between the spaced firing devices 26 and this rod serves the purpose of mounting a control means or control devices generally designated 106. The control means consists of an elongated tubular body 108 through which the rod 104 extends. An elongated central rib portion 110 is formed on the body and it carries an integral depending spring finger 112 which projects downwardly so that the lower end thereof fits into and through a slot 102 in the container flange 98. The control device further includes an arm 114 formed integrally with and extending forwardly from the rib 110 for the purpose of controlled engagement with both the container means and the targets. The arm 114 has a flat top surface 116, a sloped forward surface 118 having a stepped portion or notch 120 formed therein and a small rearwardly extending integral finger 122, the end of which is engageable with the upper portion of the container rear wall 86 as illustrated in FIG. 4.

The entire control device 106 is somewhat resilient so that the arm 114 is normally biased upwardly somewhat under the urging influence of the spring 112. However, when the target 74 is rotated so that the lower end 80 thereof is engaged in the notch portion 120 of the arm, such engagement holds the arm downwardly against the biasing force of the spring finger and thus holds the rearwardly extending finger 122 in engagement with the container rear wall 86. This is illustrated in FIG. 4 wherein the target 74 is shown in its upright position and the container 82 is shown in its closed position. The number of control devices 106 corresponds with the number of targets provided, which is three in the embodiment illustrated herein. Naturally, therefore, at least three slot means 102 must be provided in the container flange 98 so that each spring finger 112 can fit thereinto.

When the amusement device 10 is set up for playing, all of the targets 74 are placed in their upright position, as shown in FIG. 1. Because of the engagement of the targets with the control arms 114, this assures that the container means 82 will be retained in its closed position. When the game commences, each of the players loads projectiles into the firing devices and digitally operates the firing trigger 60 to propel such projectiles outwardly through the firing barrels 34, 38. These projectiles are launched at the targets 74 carried on the opponent's amusement device and the purpose, of course, is to strike the targets with the projectiles. The devices 10 are laterally movable along the playing surface to bring the gun barrels 38 to a position where the projectiles launched therefrom will hit an opponent's targets. If desired, the entire device can be lifted from the playing surface.

During the play of the game, as soon as a projectile squarely strikes an opponent's target, this striking force will knock the target rearwardly to a collapsed position, as shown in FIG. 5. In such position, the rear surface of the upper target portion 76 falls back and abuts against the top surface 116 of the arm 114. This target is no longer visible above the top surface T of the face member 12. As soon as such a target is knocked back to its collapsed position, thus moving the lower edge section 80 out of engagement with the notch portion 120 in the associated arm 114, the arm 114 is resiliently biased upwardly slightly under the urging influence of its associated spring finger 112. This upward biasing is only a small increment of motion, sufficient only to raise the rearwardly extending finger 122 above the top edge of the container rear wall 86. The targets 74 are, of course, knocked down one after the other. So long as at least one target remains upright, the control arm 114 associated with that target will remain down, thus assuring that the finger 122 on that arm remains in engagement with the container rear wall. As a result, so long as one target remains standing, the container means is still retained in its closed position as shown in FIG. 4. However, once the final target is knocked down and the control arm associated with that target resiliently raises somewhat, then the container means is no longer retained in its closed position, and instead, is free to rotate to its open position as shown in FIG. 5. When this occurs, the objects 92 forming the treasure can gravatationally discharge through the aperture 24 in the face member, thus signifying to the opposing player that he has won the game. That is, the game is won by knocking down all of the targets and causing the treasure in the container means to be released.

It will, of course, be obvious to those skilled in the art that the number of targets, firing devices and the like can be varied as desired. Likewise, while this game has been described in connection with a pirate ship and targets simulating pirates, the game is by no means limited to these particular simulations, and indeed, any suitable form of indicia and target means can be used. Various other changes, modifications and alterations apparent to those of ordinary skill in the art can be made without departing from the spirit and scope of the invention as defined in the appended claims.

What is claimed is:

1. An amusement device comprising:

an upstanding member having an aperture formed therein;

container means movably mounted behind said upstanding member and being adapted to contain objects, said container means being movable from a closed position where objects are retained therein to an open position where objects are released through said aperture in said upstanding member;

target means movably mounted adjacent to said upstanding member for movement from an upright position where said target means projects above said upstanding member to a collapsed position where said target means is no longer upright;

projectile firing means for launching projectiles at an opponent's target means to knock said target means from said upright position to said collapsed position; and control means engageable with said target means and said container means;

said control means serving to retain said container means in said closed position while said target means is in said upright position;

said control means releasing said container means when said target means is moved to said collapsed position whereupon said container means moves to said open position and releases the objects therein through said aperture in said upstanding member, said target means including a plurality of targets and wherein said control means retains said container means in said closed position until all of said targets are moved to said collapsed position.

2. An amusement device as defined in claim 1 wherein said control means comprises:

a rotatably mounted body;

a spring finger projecting from said body into engagement with said container means, and an arm projecting from said body, said arm having a first portion engageable with said container means when said container means is in said closed position, said arm also having a second portion engageable with each target when said target is in said upright position.

3. An amusement device as defined in claim 2 wherein said container means includes an upstanding rear wall, the upper portion of which engages with said arm first portion, and wherein said container means also includes a rear flange having slot means formed therein for reception of said spring finger.

4. An amusement device as defined in claim 3 wherein said container means further includes a base wall and side walls, said base wall, side walls, rear wall and said upstanding member serving to define the receptacle in which said objects are retained.

5. An amusement device as defined in claim 4 wherein said container means further includes a lower wall depending from said base wall, said lower wall serving to block said aperture in said upstanding member when said container means is in said closed position.

6. An amusement device as defined in claim 2 wherein a plurality of control means are provided, with one control means being associated with each target.

7. An amusement device as defined in claim 1 wherein said projectile firing means includes:

an upstanding open tube into which projectiles can be digitally inserted;

a forwardly extending barrel through which said projectiles can be launched; and a spring biased digitally operable trigger which can be retracted to cause a projectile drop through said tube into alignment with said barrel and which can be released to launch said projectile through said barrel.

8. An amusement device as defined in claim 7 wherein said projectile firing means is disposed behind said upstanding member and wherein said barrel projects through said upstanding member.

9. An amusement device as defined in claim 7 wherein said trigger includes a projection which enters said barrel when said trigger is retracted to prevent a projectile loading through said barrel.

10. An amusement device as defined in claim 1 wherein said upstanding member is a simulacrum of a pirate ship and wherein said target means are simulacrums of figures of pirates.

11. In an amusement device, mechanism comprising:

a plurality of target means;

mounting means upon which said target means are rotatably mounted for movement from an upright position to a collapsed position;

container means movably mounted adjacent to said target means, said container means being movable between a closed position adapted to contain objects and an open position where said objects are released; and control means coacting with said target means and said container means to retain said container means in closed position so long as at least one of said target means is in said upright position;

said control means releasing said container means when all of said target means are in said collapsed position whereupon said container means moves to said open position and said objects are released.

12. Mechanism as defined in claim 11 wherein said control means comprises:

rotatably mounted body means;

spring finger means projecting from said body means into engagement with said container means; and arm means projecting from said body having a first portion engageable with said container means when said container means is in closed position and having a second portion engageable with said target means when said target means is in said upright position.

13. Mechanism as defined in claim 12 wherein said arm means includes:

a flat top surface;

a sloped forward surface having a notch therein which forms said second portion; and a rearwardly extending lower finger, the end of which forms said first portion.

14. Mechanism as defined in claim 13 wherein said target means has a lower edge which fits into said notch in said arm means when said target means is upright, said target means being rotatable to said collapsed position whereat said lower edge thereof is removed from said notch and wherein a portion of said target means rests against said flat top surface of said arm means.

15. Mechanism as defined in claim 13 wherein said container means includes an upstanding rear wall and wherein the end of said lower finger on said arm means abuts against the top of said rear wall to retain said container means in said closed position.

16. Mechanism as defined in claim 12 wherein said container means includes a rear flange having slot means therein and wherein said spring finger means fit within said slot means.

17. An amusement device in the form of a simulated battle game, comprising:

an upstanding face member having decorative indicia thereon;

a pair of spaced projectile firing devices disposed behind said face member, each such projectile firing device including:

an upstanding loading tube, a forwardly extending barrel through which projectiles can be launched, and an operating trigger which can be digitally operated to propel a projectile through said barrel;

said barrels from said firing devices extending through said face member to simulate gun barrels from which said projectiles are launched;

a first rod extending between said spaced firing devices;

a plurality of targets rotatably mounted upon said first rod;

each of said targets including an upper portion which projects above said face member when said targets are in an upright position, said targets having decorative indicia on said upper portions and said upper portions serving as targets at which an opponent directs his projectiles;

each of said targets further including a lower edge portion;

a second rod extending between said spaced firing devices;

a container rotatably mounted upon said second rod;

said container including a base wall, an upstanding rear wall, spaced side walls and a rearwardly projecting flange;

said container base wall, rear wall, side walls and the reverse side of said face member serving to define a chamber in which objects can be contained while said container is in its closed position;

said face member having an aperture formed therein and the front of said base wall being substantially aligned with the top of said aperture when said container is in its closed position and being substantially aligned with the bottom of said aperture when said container moves to its open position;

said rearwardly projecting flange having a plurality of slots formed therein, with the number of slots at least corresponding with the number of targets so that each target has an associated slot;

a third rod extending between said spaced firing devices;

a plurality of control devices rotatably mounted on said third rod, with the number of control devices corresponding with the number of targets;

each of said control devices comprising:

a body having a transverse bore through which said third rod projects;

a spring finger projecting from said body and into one of said slots in said container flange; and a forwardly projecting arm having a front portion with a notch therein and having a rearwardly extending lower finger;

said amusement device being initially set up with said target lower edge portions engaged in said notches and with said lower fingers abutting against the top portion of said container rear wall, whereby said targets are upright and said container is in its closed position;

said targets being rearwardly rotated when struck by a projectile launched from an opponent's firing device, said rearward rotation causing said target upper portion to rest upon the top of said target lower edge portion to be retracted from said notch;

said control devices being resiliently biased upward slightly by said spring fingers so that when a target lower edge portion is retracted from a notch, the arm will bias upwardly by a distance sufficient for the lower finger on that arm to raise above the top of the container rear wall;

said container being released by said control devices when the last of the targets has been rearwardly rotated, whereupon said container can rotate downwardly to its open position to cause the objects therein to be released through said aperture in said face member.

18. An amusement device as defined in claim 17 wherein said firing device trigger is spring-biased forwardly to prevent a projectile inserted into said loading tube from dropping into alignment with said forwardly extending barrel, said trigger being digitally retractable to permit a projectile to drop into alignment with said barrel, said trigger being forwardly movable when digitally released, under said spring-biasing force, to propel said projectile forwardly through said barrel.

19. An amusement device as defined in claim 18 wherein said trigger includes a projection which enters said barrel when said trigger is retracted to prevent projectiles from being effectively loaded through said barrel.

20. An amusement device as defined in claim 17 wherein said container further includes a lower wall depending from the front portion of said basewall, said lower wall serving to block said aperture in said face member when said container is in said closed position.

21. An amusement device as defined in claim 17 wherein said face member decorative indicia simulates a pirate ship and wherein said target decorative indicia simulates pirates.

* * * * *